United States Patent [19]

Tamekio

[11] Patent Number: 4,991,555

[45] Date of Patent: Feb. 12, 1991

[54] AIR-FUEL RATIO CONTROL SYSTEM FOR AUTOMOTIVE ENGINE

[75] Inventor: Masaaki Tamekio, Hatsukaichi, Japan

[73] Assignee: Mazda Motor Corporation, Hiroshima, Japan

[21] Appl. No.: 479,431

[22] Filed: Feb. 14, 1990

[30] Foreign Application Priority Data

Feb. 14, 1989 [JP] Japan ..... 1-32660

[51] Int. Cl.[5] ..... F02D 33/00; F02M 7/00

[52] U.S. Cl. ..... 123/436; 123/419

[58] Field of Search ..... 123/419, 436

[56] References Cited

U.S. PATENT DOCUMENTS 4,064,846 12/1977 Latsch et al. ..... 123/436
4,232,643 11/1980 Leshner et al. ..... 123/436
4,502,442 3/1985 Takakuwa et al. ..... 123/436
4,543,934 10/1985 Morita et al. ..... 123/436
4,683,856 8/1987 Matsuura et al. ..... 123/419

*Primary Examiner*—Tony M. Argenbright
*Assistant Examiner*—Robert E. Mates
*Attorney, Agent, or Firm*—Fleit, Jacobson, Cohn, Price, Holman & Stern

[57] ABSTRACT

An air-fuel ratio control system for an automotive engine controls an air-fuel ratio at which fuel is delivered to the automotive engine to a desirable lean air-fuel ratio so as to maintain the automotive engine to operate with a predetermined degree of instability less than an allowable degree of instability. The air-fuel ratio control system sets a desirable lean air-fuel ratio to an air-fuel ratio shifted toward a side of more rich air-fuel ratios by a predetermined value from the leanest air-fuel ratio at which the automotive engine operates with a predetermined degree of instability and a lower guard of air-fuel ratio to an air-fuel ratio shifted toward a side of more lean air-fuel ratios by a predetermined value from the desirable lean air-fuel ratio.

7 Claims, 5 Drawing Sheets

AIR-FUEL RATIO CONTROL SYSTEM FOR AUTOMOTIVE ENGINE

FIELD OF THE INVENTION

The present invention relates to an air-fuel ratio control system for an automotive engine, and more particularly to an air-fuel ratio control system which prevents the automotive engine prevented from a rapid change of the operational stability of the automotive engine due to a wide range of changes of desirable air-fuel ratio.

BACKGROUND OF THE INVENTION

One known type of air-fuel ratio control system for an automotive engine regulates an air-fuel ratio to the leanest extent considerably close to a critical air-fuel ratio at which misfiring may possibly occur so as to keep the degree of operating instability of the automotive engine less than an allowable degree of operating instability. The term "operating instability" as used herein shall mean and refer to the degree of change in engine speed or in engine vibration. In the air-fuel control system, a characteristic curve of operating instability relative to an air-fuel ratio for an automotive engine is experimentally provided so as to determine the leanest air-fuel ratio in a range wherein the automotive engine operates with an allowable degree of operating instability. Such an air-fuel ratio control system is known from, for example, Japanese Patent Publication No. 56(1981)-33571 entitled "Air-Fuel Ratio Control System For Internal Combustion Engine" published Aug. 4, 1981.

SUMMARY OF THE INVENTION

It is a primary object of the present invention to provide an air-fuel ratio control system for an automotive engine for controlling an air-fuel ratio to a desirable lean air-fuel ratio so as to maintain the automotive engine to operate with a predetermined degree of operating instability less than a critical or upper allowable degree of operating instability.

It is another object of the present invention to provide an air-fuel control system for an automotive engine in which the automotive engine is prevented from a rapid change of operating stability due to a wide range of change in a desirable lean air-fuel ratio.

The above objects of the present invention is achieved by providing an air-fuel ratio control system for an automotive engine which provides a desirable lean air-fuel ratio considerably close to the leanest air-fuel ratio, at which ratio the automotive engine operates with a critical degree of operating instability, by changing a feedback control value. The air-fuel ratio control system comprises means for setting a desirable lean air-fuel ratio which is shifted by a predetermined value from the leanest air-fuel ratio toward the rich side of a rich air-fuel ratio and means for setting a lower guard value of an air-fuel ratio to one shifted by a predetermined value from the desirable lean air-fuel ratio toward a lean side of an air-fuel ratio.

The air-fuel ratio control system in accordance with the present invention thus structured prevents an air-fuel ratio from being controlled to make an air-fuel mixture excessively lean even when the operating stability of an automotive engine is temporarily improved, and accordingly, the automotive engine is prevented from rapidly increasing its operating instability when restoring its normal degree of operating instability.

BRIEF DESCRIPTION OF THE DRAWINGS

The above and other objects and features of the present invention will be apparent to those skilled in the art from the following description of a preferred embodiment thereof when taken in conjunction with the accompanying drawings, in which.

DETAILED DESCRIPTION OF THE PREFERRED EMBODIMENT

Figure 1:
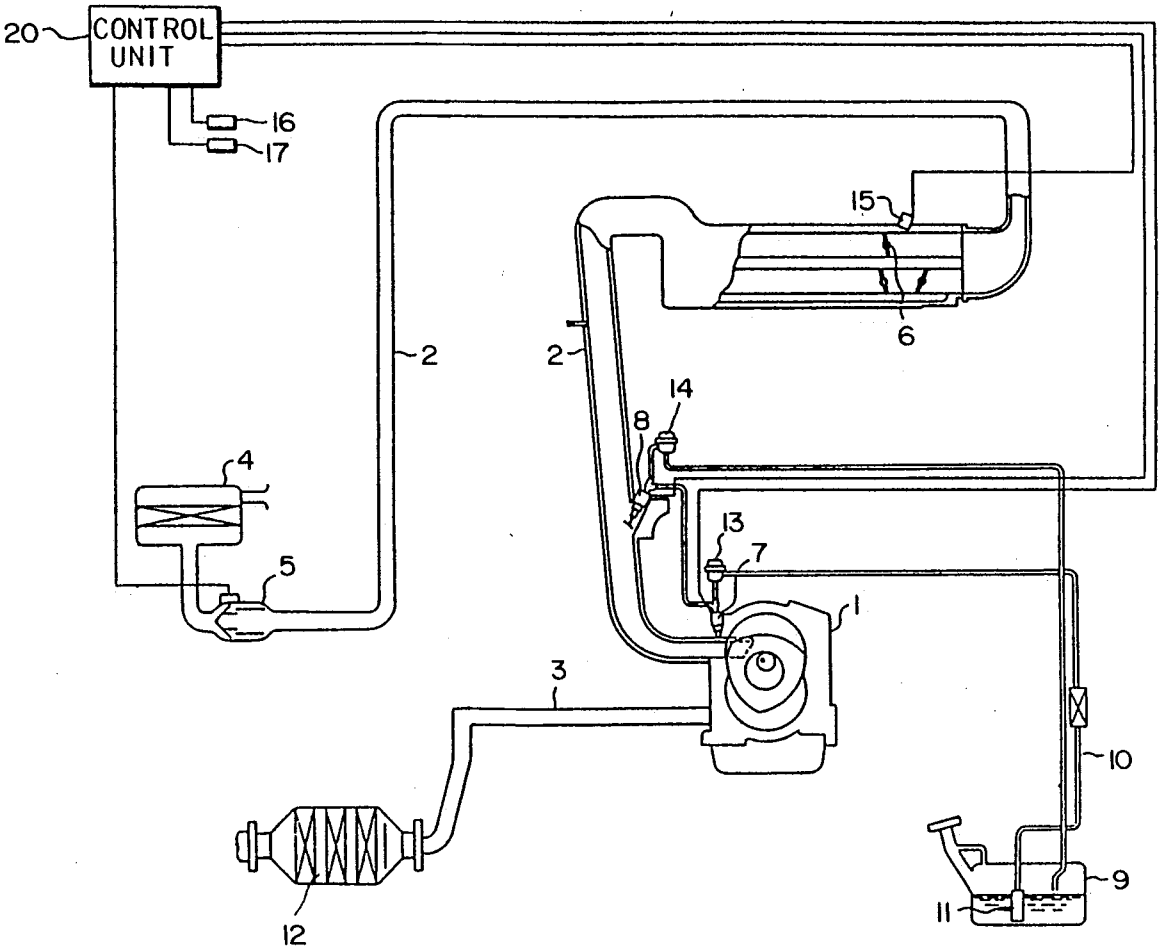
FIG. 1 is a schematic illustration showing an air-fuel ratio control system in accordance with a preferred embodiment of the present invention.

Referring to the drawings in detail, particularly to FIG. 1, an air-fuel control system for an automotive engine in accordance with a preferred embodiment of the present invention is shown, cooperating with, for example, a rotary engine generally designated by a numeral 1. The rotary engine 1 has an intake pipe 2 and an exhaust pipe 3. The intake pipe 2 is provided with an air cleaner 4, and air flow meter 5, a throttle valve 6 and primary and secondary fuel injection nozzles 7 and 8 disposed in order moving upstream from the engine 1. These primary and secondary fuel injection nozzles 7 and 8 are connected to a fuel tank 9 through a fuel pipe 10 to deliver fuel into the intake pipe 2, and hence the rotary engine 1, by a fuel pump 11. The fuel pipe 10 is provided with a damper 13 for preventing pulsation of the fuel and a fuel pressure regulator 14. Connected to the exhaust pipe 3 at its one end is a catalytic converter 12.

A control unit 20, mainly comprising a microcomputer, is connected to outputs of various sensors or meters, such as the air flow meter 5, a throttle opening sensor 15 cooperating with the throttle valve 6, an engine speed sensor 16 and an engine temperature sensor 17 to constantly monitor engine speed, throttle position or opening, intake air flow and engine temperature, respectively. Based on these incoming output signals the control unit 20 is constantly adjusting pulse width for pulsing the fuel injection nozzle so as to deliver a controlled air-fuel ratio of fuel mixture for any given engine demand.

Figure 2:
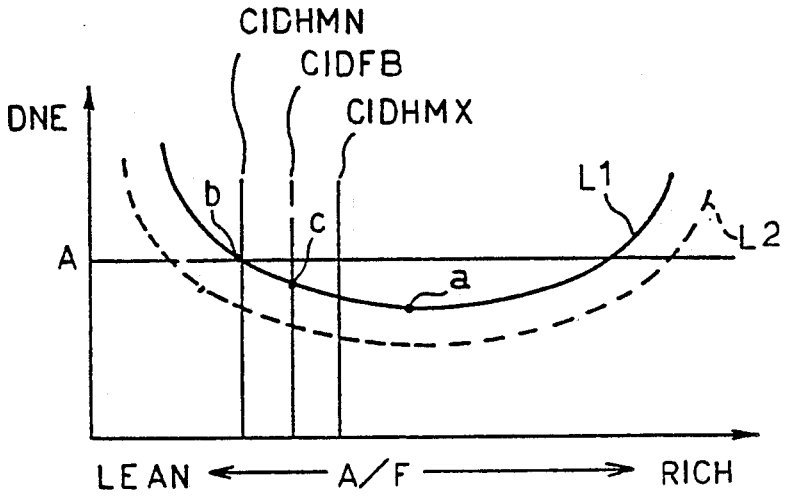
FIG. 2 is a graph showing the operating instability of an engine.

The control unit 20 also performs controls or functions, such as providing the leanest air-fuel ratio which is defined as a ratio considerably close to a critical air-fuel ratio at which the rotary engine 1 may misfire, monitoring the leanest air-fuel ratio and establishing upper and lower limits of air-fuel ratio above and below the leanest air-fuel ratio. To understand the air-fuel ratio control according to the present invention, an example is given and briefly described with reference to FIG. 2. The operating instability DNE of the rotary engine 1 is detected, for instance, a value a on an ordinarily operating instability characteristic curve L1 relative to air-fuel ratio (A/F). If the operating instability DNE of the rotary engine 1 is lower than a maximum allowable or critical operating instability A, after slightly shifting the air-fuel ratio a toward the lean side of an air-fuel ratio, another detection of the operating instability of the rotary engine 1 is effected. The detection is repeated until the critical operating instability A is reached. An air-fuel ratio at which the critical operating instability A is reached is determined as the leanest air-fuel ratio b. Then, an air-fuel ratio c which is obtained by shifting the leanest air-fuel ratio b by a predetermined value toward the rich side of an air-fuel ratio is taken for the desirable lean air-fuel ratio LAF. Upper and lower guard values ULAF and LLAF, are predetermined values smaller and larger than the desirable lean air-fuel ratio LAF, respectively, are established on both sides of the desirable lean air-fuel ratio LAF. The desirable lean air-fuel ratio LAF is controlled so as to be always between the upper and lower guard values ULAF and LLAF, thereby the rotary engine 1 always operates with desired operating stability under its ordinary conditions of operation. The determination of the desired lean air-fuel ratio LAF and the upper and lower guard values LLAF and ULAF is made at idling after the rotary engine 1 has been warmed up. For this reason, the control unit 20 is connected to outputs of various engine condition sensors, such as the throttle opening sensor 15, engine speed sensor 16 and engine coolant temperature sensor 17 which may be of any type well known in the art. In FIG. 2, a characteristic curve L2 shows a temporarily improved operating stability characteristic curve relative to air-fuel ratio (A/F).

Figure 3A:
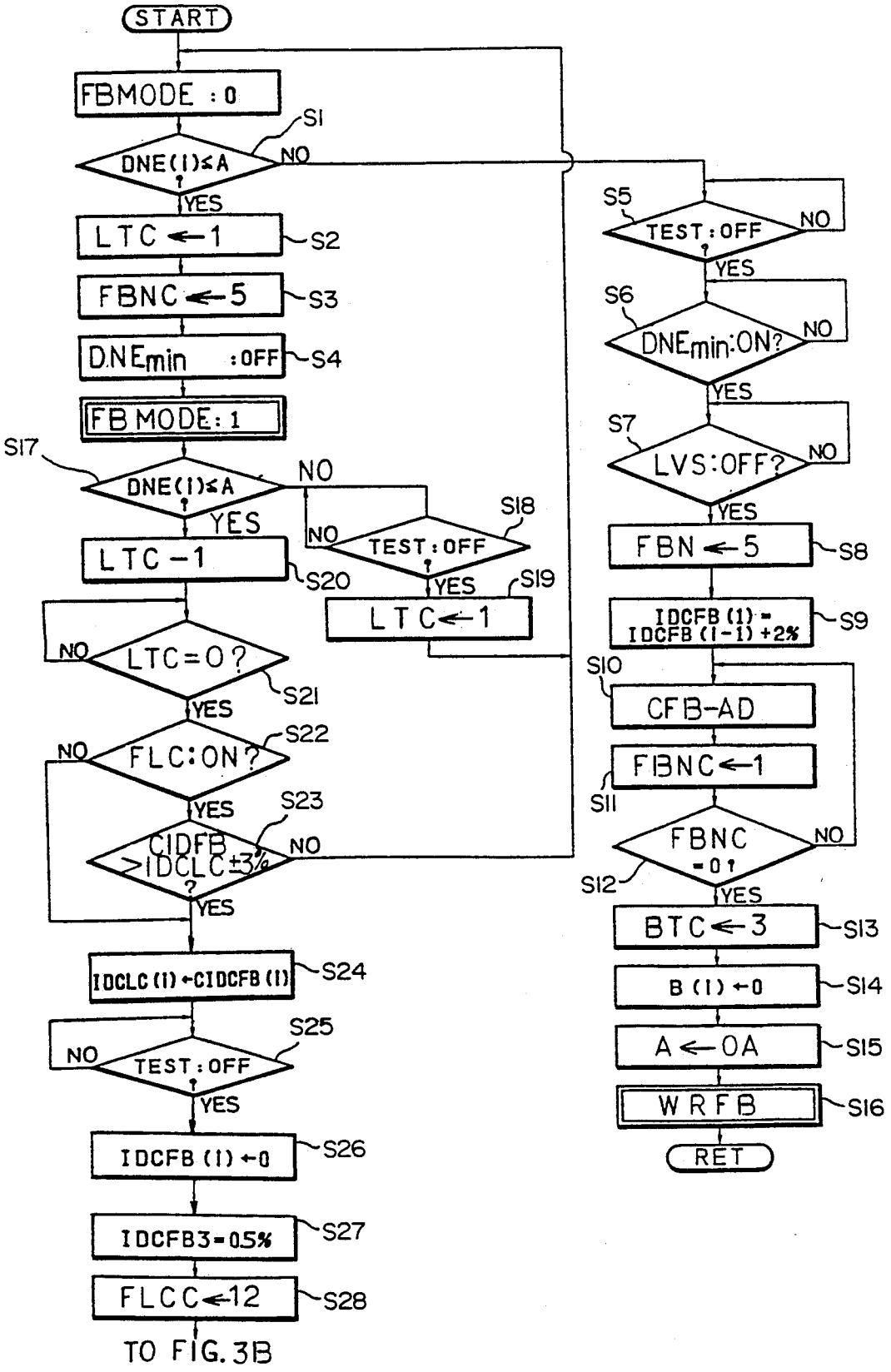
FIGS. 3A and 3B are a flow chart of an air-fuel ratio control routine.
Figure 3B:
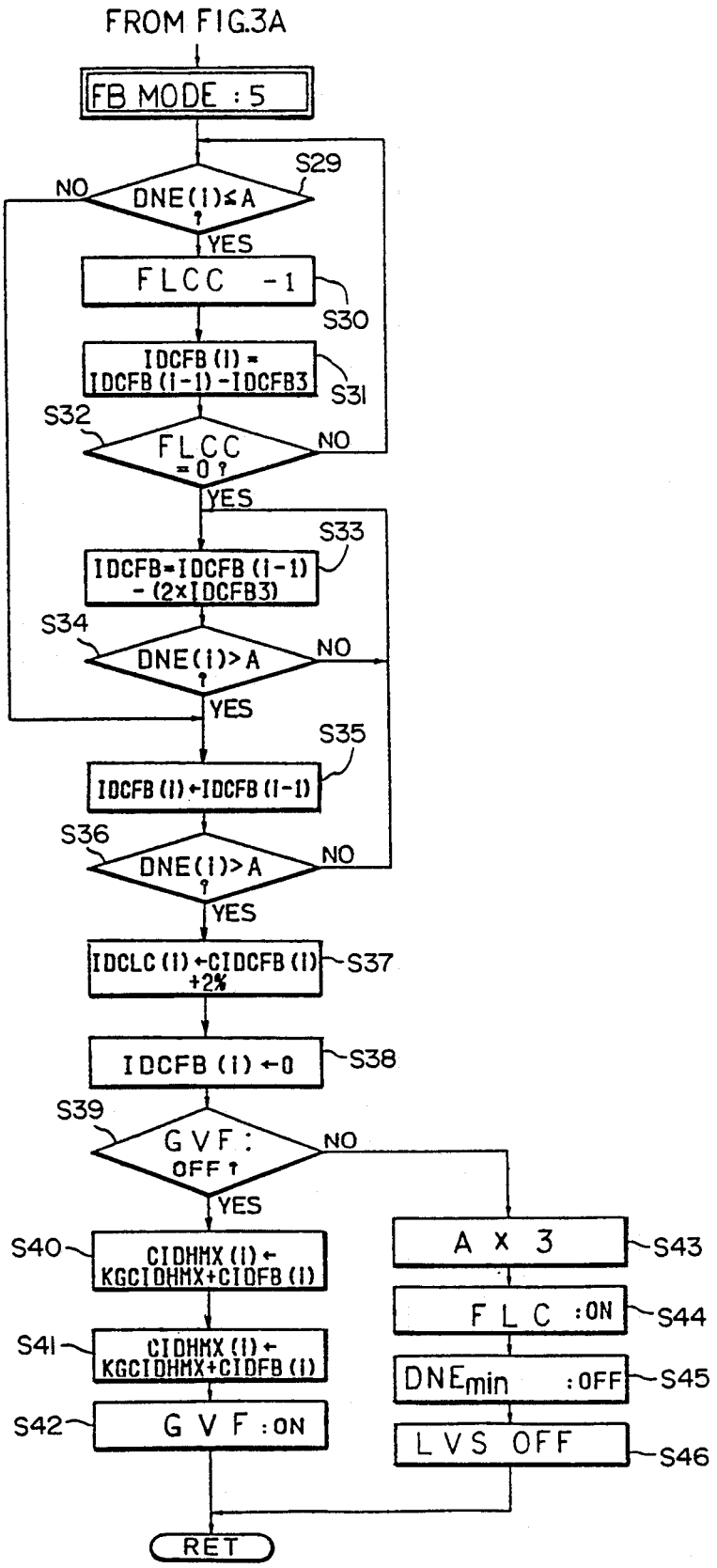
Figure 4:
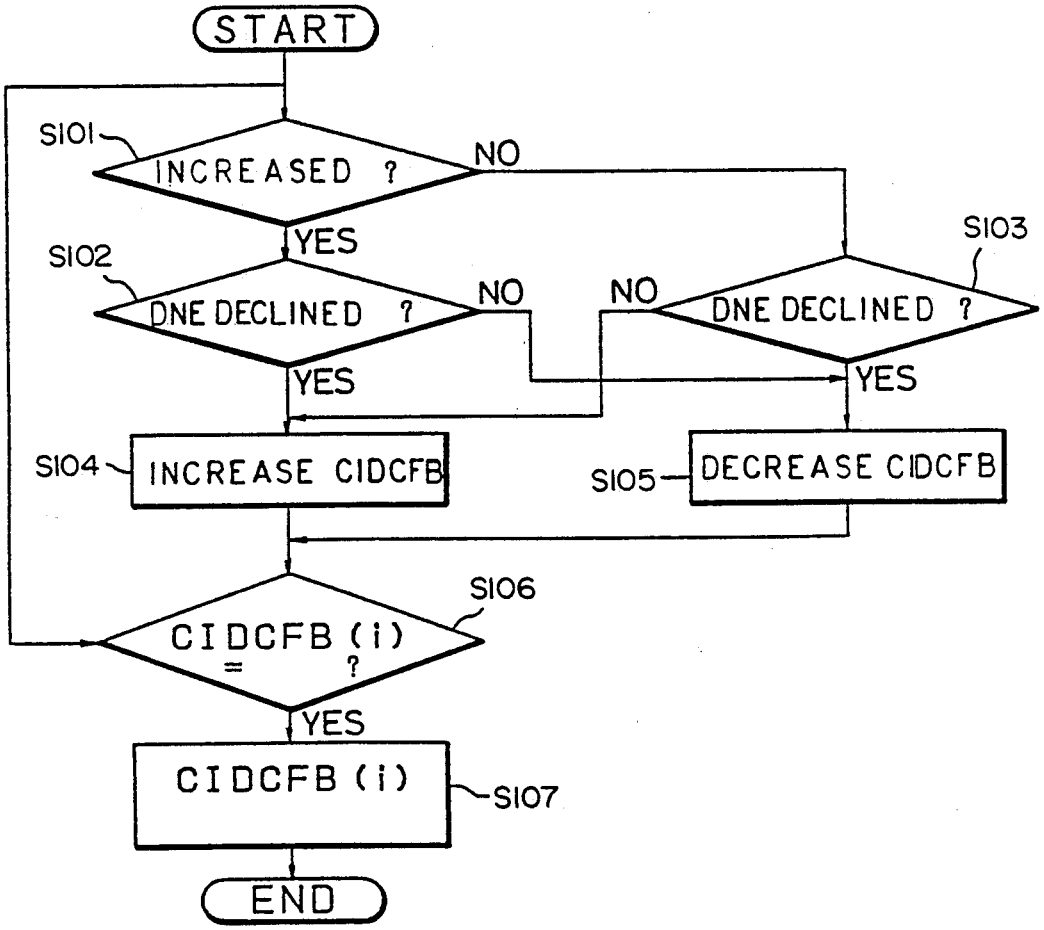
FIG. 4 is a flow chart of a feedback control value readjusting routine.

The operation of the air-fuel ratio control system depicted in FIG. 1 is best understood by reviewing FIGS. 3 and 4, which are flow charts illustrating routines for the microcomputer of the control unit 20. Programming a computer is a skill well understood in the art. The following description is written to enable a programmer having ordinal skill in the art to prepare an appropriate program for the microcomputer of the control unit 20. The particular details of any such program would of course depend upon the architecture of the particular computer selected.

FIGS. 3A and 3B are a flow chart of the main or general sequence routine of fuel control for the microcomputer of the control unit 20. It is to be noted that the operating instability DANE in this embodiment is defined as the total change NE of rotations in r.p.m. every 180 degrees of rotation of the crank shaft of the engine at idling for ten seconds. The fuel control begins first in a feedback control preparatory mode (FB mode: 0) and the first step in the feedback control preparatory mode is to make a decision in step S1 whether or not a current operating instability DNE(i) is equal to or smaller than a predetermined critical operating instability A which is predetermined to be, for example, 1000 r.p.m. If the answer to the decision indicates that the rotary engine 1 is operating with a lower operating stability than the critical operating instability A, then, a learning timer counter LTC is set to a value of one (1) which is equivalent to ten seconds, in step S2. Succeedingly, after having set a feedback number counter FBNC for counting the number of controls effected set to a value of five (5) in step S3 and then resetting or turning a desired lean air-fuel ratio flag DNEmin OFF in step S4, an air-fuel ratio learning mode (FB mode: 1) is taken.

On the other hand, if the answer to the decision in stepe S1 is no, indicating that the rotary engine 1 is operating in an instable condition, then, a decision is made in step S5 whether or not a test flag TEST has been reset or turned OFF. The test flag TEST having been set ON indicates that an idling air-fuel ratio set in the manufacturing process of the rotary engine 1 is maintained. If the answer to the decision is no, the decision in step S5 is made again. This decision in step S5 is repeatedly made until the answer becomes yes. The yes decision is followed by another decision in step S6 to judge whether or not the desired lean air-fuel ratio DNEmin has been set or turned ON. This other decision is repeatedly made until the answer becomes yes. The yes decision indicates that the desired lean air-fuel ratio flag DNEmin has been set or turned ON. Therefore, a decision is made in step S7 to judge whether or not a learned value set flag LVS, which is set upon an occurrence of a wide range of changes of air-fuel ratio, is OFF. This decision regarding the learned value set flag LVS is also repeatedly made until the answer becomes yes. When the answer turns yes, the feedback number counter FBNC has been set to a value of five (5) in step S8.

After the setting of the feedback number counter FBNC to a value of five (5), a current feedback control value IDCFB (i) is established to the last feedback control value IDCFB (i−1) with a 2% increase thereof so as to introduce an initial increase in the amount of fuel, in step S9. Thereafter, a feedback control value (CFB-AD) readjustment subroutine is taken in step S10.

Referring now to FIG. 4, which is a flow chart illustrating the feedback control value readjustment (CFB-AD) subroutine taken in step S10, the first step in step S101 is to decide whether or not the last feedback control value IDCFB (i−1) has been increased. According to the answer yes or no to the decision in step S101, another decision is made in step S102 or step S103, respectively, to decide whether or not the operating instability DANE of the rotary engine 1 has declined in value. In any event that the answers to both the decisions in steps S101, and S102 or S103 are the same, an eventual feedback control value CIDCFB, which is defined as the sum of a current feedback control value IDCFB and a learned feedback control value IDCLC which will be described in connection with the air-fuel ratio control routine later, is increasingly changed in step S104. Otherwise, in the event the answers to the decisions are different from each other, the eventual feedback control value CIDCFB is decreasingly changed in step S105.

The current eventual feedback control value CIDCFB(i) thus increasingly or decreasingly changed in judged whether it is equal to a guard value in step S106. If the answer to the decision is yes, the current eventual feedback control value CIDCFB(ie is learned and stored. As long as the answer to the decision regarding the guard value is no, all the preceding steps S101–S105 are repeated over and over. After the learning and storing of the current eventual feedback control value CIDCFB(i), the final step orders return to the air-fuel ratio control routine.

Referring back to the main routine of FIG. 3A, after having taken the feedback control value readjustment (CFB-AD) subroutine, the feedback number counter FBNC changes its count value by an decrement of one (1) in step S11 and, thereafter, a decision is made in step S12 to judge whether or not the feedback number counter FBNC has counted down five (5). If the answer to the decision is no, steps S10 and S11 are repeated again. This repetition is made until the feedback number control counts down five (5). When the answer to the decision is yes, a B timer counter (BTC) is set to three (3) in step S13 so as to hold an air-fuel ratio learned in the air-fuel ratio learning mode (FB mode: 1) for a time period depending upon the set count after the transition into a wide-range feedback control (WRFB) of air-fuel ratio. Then, after setting the B timer counter (BTC) to zero (0) in step S14, the predetermined critical operating instability A is altered into an ordinary operating instability OA of the rotary engine 1 in step S15. In this manner, the feedback control preparatory more (FB mode: 0) is completed.

The wide-range feedback control (WRFB) is taken in step S16 if the operating instability DNE does not converge on the predetermined critical operating instability A (=1000 r.p.m.) even after continuously repeating an increasing or a decreasing change of the eventual feedback control value CIDCFB five times in the feedback control preparatory mode (FB mode: 0). The wide-range feedback control is completed when an operating instability DNE from a detection for 30 seconds becomes lower than three times as large as the predetermined critical operating instability A as a result of changing the eventual feedback control value CIDCFB by an increment of 4% or a decrement of 4% thereof. If the operating instability DNE is higher than three times as large as the predetermined critical operating instability A, then, it is changed by an increase of 2% thereof every 30 seconds when it is equal or smaller than the last operating instability DNE (i−1). This wide-range feedback control is repeated until the operating instability DNE becomes below three times as large as the predetermined critical operating instability A or until the operating stability DNE is reversed in the direction of change. However, when the readjustment of operating instability DNE is taken twice, the wide-range feedback control value CIDCFB to the mean value of the last and current eventual feedback control values CIDCFB (i−1) and CIDCFB(i).

On the other hand, if the current operating instability DNE(i) is higher than the last operating instability DNE(i−1), then, it is changed by a decrease of 2% thereof every 30 seconds. This wide-range feedback control is repeated until the operating instability DNE becomes below three times as large as the predetermined critical operating instability A or until the operating stability DNE is reversed in the direction of change. When the readjustment of operating instability DNE is taken twice, the wide-range feedback control is completed after setting the eventual feedback control value CIDCFB to the mean value of the last and current eventual feedback control values CIDCFB(i−1) and CIDCFB(i).

Referring back to step S4, in the air-fuel ratio learning mode (FB mode: 1) which is effected when, after having set a feedback number counter FBNC for counting the number of effected controls set to a value of five (5) in step S3, the leanest air-fuel ratio flag DNEmin is reset or turned OFF in step S4, the same decision as in step S1 is made step S17 whether or not the current operating instability DNE(i) is equal to or smaller than the predetermined critical operating instability A. If the answer to the decision in step S17 is no, indicating that the rotary engine 1 is operating in an instable condition, then, a decision is made in step S18 whether or not the test flag TEST has been reset or turned OFF. If the answer to the decision is no, the decision in step S18 is made again. This decision in step S18 is repeatedly made until the yes decision is made. The yes decision is followed by ordering return to start after setting the learning timer counter LTC to a value of one (1) in step S19.

On the other hand, if the answer to the decision in step S17 is yes, then, after decreasingly changing or counting down the value of the learning timer counter LTC by one (1) in step S20, a decision is made until the learning timer counter LTC counts down to zero (0) in step S21. The counting down to zero, which indicates that the current operating instability DNE(i) equal to or lower than the predetermined critical operating instability A has been maintained for 10 seconds, is followed by a decision whether a forced leaning control has been effected in step S22. If the forced leaning control flag FLC has been set or turned ON, a decision is made in step S23 whether a current eventual feedback value CIDCFB(i) is larger than 3% of a learned value IDCLC memorized in a back-up memory. If the answer to the decision regarding the learned value is no, then, the step S23 orders return to start, while leaving the learned feedback control value IDCLC intact.

On the other hand, if the answer to the decision regarding the forced learning control flag FLC has been reset or turned OFF or the answer to the decision in step S23 indicates that the current eventual feedback value CIDCFB(i) is larger than 3% of the learned value IDCLC, then, a learned value is made by replacing the current learned value(i) IDCLC with the current eventual feedback control value CIDCFB(i) which is equivalent to the sum of a feedback value IDCFB and a learned feedback control value IDCLC. Thereafter, the same decision as in step S5 is made in step S25 whether the test flag TEST is reset or turned OFF. This decision is repeatedly made until the yes decision is made. When the yes decision is made, after clearing the current feedback control value IDCFB(i) or setting it to zero (0) in step S26, a forced leaning feedback control value IDCFB3is set to 0.5% in step S27 and a forced leaning control counter FLCC is set to a value of twelve (12) in step S28 in order. This count value of twelve (12) is equivalent to 180 seconds. Succeedingly, a control is taken in a forced leaning feedback control mode (FB mode: 5).

In the forced leaning feedback control, the first decision is made in step S29 whether the current operating instability DANE(i) is equal to or lower than the predetermined critical operating instability A, namely 1,000 r.p.m. in this embodiment. If the answer to the decision is yes, after making the forced leaning control counter FLCC change in its count by a decrement of one (1) in step S30, the forced leaning feedback control is carried out with the current feedback control value IDCFB(i) which takes a value equal to the difference of the last feedback control value IDCFB(i−1) from the forced leaning control value IDCFB3 which is initially set to 0.5% in step S31. During the forced leaning control a decision is always made in step S32 whether the forced leaning control counter FLCC has counted down to zero (0). As long as the forced leaning control counter FLCC does not count down to zero (0), the forced leaning control is repeated. This means that the forced leaning control is continuously effected for 180 seconds.

If the current operating instability DNE(i) still remains lower than the predetermined change of rotation A after the forced leaning control counter FLCC has counted to zero or after the time period of 180 seconds has elapsed, then, the current feedback control value IDCFB(i) takes a value equal to the difference of the last feedback control value IDCFB(i−1) from two times as large as the forced leaning control value IDCFB3 of 0.5%, that is 1.0%, and the forced leaning control is carried out with the current feedback control value IDCFB(i) in step S33. Thereafter, a decision is made in sep S34 whether the current operating instability DNE(i) is higher than the predetermined critical operating instability A. As long as the answer to the decision concerning the current operating instability DNE(i) is smaller than the predetermined critical operating instability A, the forced leaning control is repeatedly made in step S33.

As soon as the yes decision is made in step S34 or if the answer to the decision is step S29 indicates that the current operating stability DNE(i) is higher than the predetermined critical operating instability A, the last feedback control value IDCFB(i−1) is taken as a current feedback control value (i) in step S35, thereby suspending temporarily the feedback control. This is because, nevertheless, the current operating instability DNE(i) becomes higher than the predetermined critical operating instability A, it is desirable to ignore the first stage of firing in order to see as indication of misfiring at early stages of firing since there is the possibility of misfiring at the first stage. Thereafter, the same decision concerning the current operating instability DNE(i) as in step S34 is made in step S36. If the answer to the decision in step S36 is yes, this indicates that the air-fuel ratio is substantially similar to the leanest air-fuel ratio. Then, the eventual feedback control value CIDCFB is increased by a predetermined rate of 2% in step S37 and stored as a current learned value IDCLC(i). That is, the eventual feedback control value CIDCFB which has been forcibly shifted closely to the leanest air-fuel ratio is shifted back toward the rich side of air-fuel ratios by being added by the predetermined rate of 2% so as thereby to bring the operating instability DANE down below the predetermined critical operating instability A and is leaned as a readjusted desirable lean air-fuel value.

The current feedback control value IDCFB(i) is reset to zero in step S38 after the readjustment of desirable lean air-fuel value and then, a decision concerning a guard value set flag GVF is made in step S39. If answer to the decision is yes or indicates that the guard value set flag GVF has not yet been reset or turned OFF, an upper or rich side guard value is set to a value CIDHMX which is the sum of the current eventual feedback control value CIDCFB(i) and a predetermined value KGCDHMX in step S40; a lower or lean side guard value is set to a value CIDHMN which is the difference of the current eventual feedback control value CIDCFB(i) from the predetermined value KGCDHMX in step S41. Thereafter, the guard value set flag GVF is set or turned ON in S42 and the final step orders restart of the air-fuel feedback control routine.

On the other hand, the answer to the decision concerning the guard value set flag GVF in step 39 indicates that the guard value set flag GVF has been set or turned ON, the predetermined critical operating instability A is tripled and is replaced therewith as a readjusted critical operating instability OA in step S43. This is because, if leaving the predetermined critical operating instability A intact, the feedback control is resumed due to a misfiring at the earliest stage of firing, resulting in an undesirable change of the leanest air-fuel ratio. Thereafter, in step S44, the forced leaning control flag FLC is set or turned ON to indicate that the forced leaning control, induced at high operating instabilities, has been completed: in step S45, the leanest air-fuel flag DNEmin is set or turned ON: and finally in step S46, the learned value set flag LVS is set or turned ON. This final step orders restart of the feedback control routine.

Although the present invention has been fully described by way of the preferred embodiment thereof with reference to the accompanying drawings, it is to be noted that various changes and modifications are apparent to those skilled in the art. Therefore, unless otherwise such changes and modifications depart from the true spirit and scope of the present invention, they should be construed as included therein.

What is claimed is:

1. A air-fuel control system for an automotive engine for controlling an air-fuel ratio at which fuel is delivered to the automotive engine to a desirable lean air-fuel ratio so as to maintain the automotive engine to operate with a predetermined degree of instability less than an allowable limit of instability, said air-fuel ratio control system comprising:

leanest air-fuel ratio detecting means for detecting the leanest air-fuel ratio at which said automotive engine operates with said predetermined degree of instability;

eventual air-fuel ratio setting means for setting said desirable lean air-fuel ratio to an air-fuel ratio shifted by a predetermined value from said leanest air-fuel ratio toward a rich side of air-fuel ratio; and guard value setting means for setting a lower guard value of air-fuel ratio to an air-fuel ratio shifted by a predetermined value from said desirable lean air-fuel ratio toward a lean side of air-fuel ratio.

2. An air-fuel ratio control system as defined in claim 1, wherein said instability is represented by a change of speed in rotation of said automotive engine.

3. An air-fuel ratio control system as defined in claim 1, wherein said guard value setting means sets an upper guard value of air-fuel ratio to an air-fuel ratio shifted by a predetermined value from said desirable lean air-fuel ratio toward said rich side of air-fuel ratio.

4. An air-fuel control system for an automotive engine for feedback controlling an air-fuel ratio at which fuel is delivered to the automotive engine at a desirable lean air-fuel ratio so as to maintain the automotive engine to operate with a predetermined degree of instability less than an allowable limit of instability, said air-fuel ratio control system comprising:

leanest air-fuel determining means for determining the leanest air-fuel ratio at which said automotive engine operates with said predetermined degree of instability by changing a feedback control value;

eventual air-fuel ratio setting means for setting said desirable lean air-fuel to an air-fuel ratio shifted by a predetermined value from said leanest air-fuel ratio toward a rich side of air-fuel ratio; and guard value setting means for setting a lower guard value of air-fuel ratio to an air-fuel ratio shifted by a predetermined value form said desirable lean air-fuel ratio toward a lean side of air-fuel ratio.

5. An air-fuel ratio control system as defined in claim 4, wherein said leanest air-fuel ratio determining means repeatedly changes a current feedback control value by decreasing the last feedback control value by a predetermined value for a predetermined time period when a current degree of instability is less than said predetermined degree of instability.

6. An air-fuel ratio control system as defined in claim 5, wherein said leanest air-fuel ratio determining means changes a current feedback control value by decreasing the last feedback control value by a predetermined number of times of said predetermined value when said current degree of instability is still less than said predetermined degree of instability after an elapse of said predetermined time period.

7. An air-fuel ratio control system as defined in claim 6, wherein said leanest air-fuel ratio determining means repeatedly decreases the last feedback control value by a predetermined number of times of said predetermined value as long as said current degree of instability is less than said predetermined degree of instability.

* * * * *